United States Patent [19]

Stockman

[11] 4,417,615

[45] Nov. 29, 1983

[54] CAST IRON RECUPERATOR

[75] Inventor: Richard F. Stockman, Friendship, N.Y.

[73] Assignee: Air Preheater Company, Inc., Wellsville, N.Y.

[21] Appl. No.: 218,892

[22] Filed: Dec. 22, 1980

[51] Int. Cl.[3] ..... B22D 19/04

[52] U.S. Cl. ..... 164/94; 164/98; 164/111; 164/112

[58] Field of Search ..... 164/30–32, 164/9–11, 94–95, 111–112, 98

[56] References Cited

U.S. PATENT DOCUMENTS 537,463 4/1895 Hunter ..... 164/98

3,426,832 2/1969 Phillips ..... 164/11

*Primary Examiner*—Nicholas P. Godici

*Assistant Examiner*—Richard K. Seidel

*Attorney, Agent, or Firm*—William W. Habelt

[57] ABSTRACT

A method of casting a hollow bodied plate type recuperative heat exchange envelope. The heat exchange envelope comprises first and second envelope halves cast independently, then bonded together by fusion of molten metal of the second envelope half with solidified metal of the first envelope half. The first envelope half includes a lateral flange on opposite sides thereof that is confronted by the molten metal of the second envelope half to form a flange that connects envelope halves providing an increased area of contact therebetween. The flange of the second envelope half includes multiple surface areas that become fused to opposite sides of the first envelope half to form a strong connection impervious to fluid leakage.

6 Claims, 6 Drawing Figures

CAST IRON RECUPERATOR

BACKGROUND OF THE INVENTION

Because of its resistance to corrosion and erosion, its superior heat transmission capabilities, and because of its tendency to resist the deposition of particulate matter thereon, cast iron has long been deemed a superior constituent of recuperative heat exchangers.

Previous patent art including U.S. Pat. Nos. 1,992,097, 2,537,276, and U.K. Pat. No. 1,197,409 is directed to arrangements that utilize various forms of cast iron plates held together by a multiplicity of longitudinal bolts. The individual plates of the heat exchanger are assembled by hand, bolts are inserted through holes in the plates, and fastening means such as nuts are individually placed thereon to provide an assembled unit. A gasket material such as asbestos rope is commonly positioned between cast halves of the recuperator before they are bolted together to provide a seal that precludes the flow of fluid between abutting recuperator halves.

Such a manufacturing process is slow and it requires excessive amounts of manpower to laboriously assemble and properly connect the separate parts of the heat exchanger into an integral unit. Moreover, the holes through the several plates seriously weaken them to require additional reinforcement that adds even more to the cost and weight of the heat exchanger. Casting a heat exchanger of the type defined as independent halves is, however, a procedure necessitated by the intricate interior configuration and the great size of a completed unit.

SUMMARY OF THE INVENTION

This invention is directed to a method of casting an envelope for a recuperative type heat exchanger wherein a section comprising the bottom half of the envelope is first cast to provide a predetermined concave form substantially surrounded by a peripheral flange that extends laterally outward therefrom. A mold having a green sand core is then prepared to form the convex top half of the envelope. This mold is subsequently superimposed over the bottom half of the envelope. Hot, molten metal is then poured into the mold for the top half of the envelope. The hot, molten metal forms the upper half of the envelope with an edge surface lying in juxtaposition with the peripheral flange of the lower half of the envelope. Upon cooling, the two flanges become fused together to form a locking flange that includes a reverse projection poured integrally with the peripheral flange thus forming a joint connecting the two envelope halves with a fluid-tight bond therebetween. The flange between envelope halves becomes fused to the peripheral flange on the bottom half of the envelope thus forming a connection that is fluid-tight, even though there is inadequate fusion between envelope halves. Moreover, the envelope is produced with a minimum of labor at a minimum of expense, and there is no limitation as to its size or shape.

DESCRIPTION OF THE PREFERRED EMBODIMENT

Figure 1:
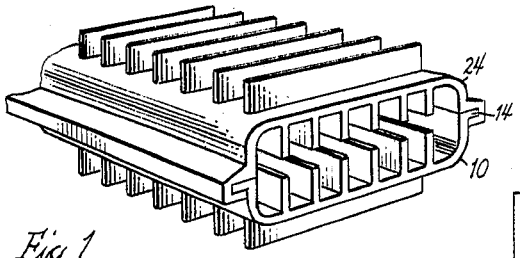
FIG. 1 of the drawing is a perspective view of a cast iron heat exchange envelope having lateral flanges as defined in the present application.

The invention comprises a method of making a cast iron envelope for a recuperative heat exchanger of the type shown by FIG. 1. Usually, a heat exchanger of the type illustrated includes a series of adjacent envelopes that each comprise superimposed concave and convex halves held together by a series of hand tightened bolts. Each envelope is subsequently bolted to an adjacent envelope to comprise an assembly having a series of connected units, a process requiring excessive amounts of hand labor.

The assembled units are large, often exceeding eight to ten feed in length, and since the total weight of an assembly depends upon the cumulative weight of the individual units, a completed assembly is frequently excessively large and heavy. Moreover, it requires an extensive amount of hand labor to assemble and place in an operable condition, and when completed it is subject to excessive fluid leakage between confronting parts.

This invention substitutes a metallic fusion of envelope halves along spaced sides thereof to provide an effective bonding of elements having maximum strength and a minimum assembly cost.

This invention requires the initial casting of a first or lower half 10 of a recuperator envelope. This half of the heat exchange envelope is cast according to existing techniques to comprise a concave wall having a flat edge surface 12 with lateral ears 14 that extend outward along opposite sides thereof.

Figure 2:
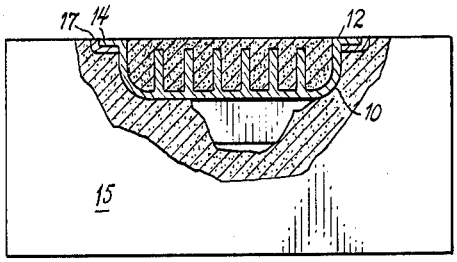
FIG. 2 is an end view of a sand mold (drag) supporting the bottom half of a cast exchange envelope filled with rammed green sand.

The lower half 10 is then disposed in a drag 15 (lower half of a flask) that is subsequently rammed with green sand, the entire assembly then being adapted to present the concave inner wall of the casting 10 facing upward in the manner shown in FIG. 2. The lower half of the envelope 10 is then also filled with said to complete the lower part of a flask holding the lower half of the envelope.

Figure 3:
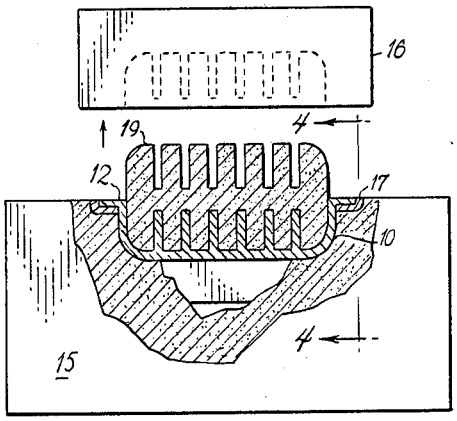
FIG. 3 is an end view of the arrangement shown in FIG. 2 with an inverted core box raised to show the upper portion of a sand core superimposed over the lower portion to comprise a complete core.

A core box 16 having an inner pattern that conforms to the upper wall of the envelope is then rammed with sand, inverted upon the sand core for the lower half of the envelope 10, and then removed to provide a complete core 19 for the inside of an envelope as shown in FIG. 3.

A pattern 18 having the outer configuration of the upper part of the envelope is then properly placed in a cope 22 (top half of a flask) and subsequently rammed with green sand to provide, upon removal of the pattern, the upper half of a sand mold for the exterior of the envelope 24. This part of the mold would be simultaneously formed to include suitable sprues 26 and gates 28 for the application of molten metal to a cavity formed between the sand core and the cope in accordance with standby foundry procedure.

The drag 15 (bottom half of the flask) would include an undercut space 32 beneath the ears 14 of the lower half of envelope 10 whereby molten metal common to the top half of the casting would surround the ears 14, fusing to both the top and bottom sides of each ear thereby providing a double flange that substantially surrounds each ear 14 and imparts increased strength thereto.

Figure 4:
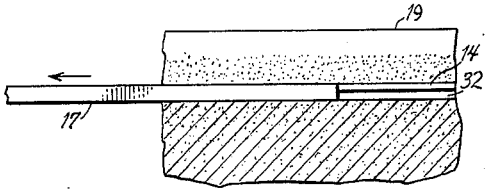
FIG. 4 is a side elevation showing an arrangement for preparing a void in the lower portion of the sand mold, subjacent a lateral flange.
Figure 5:
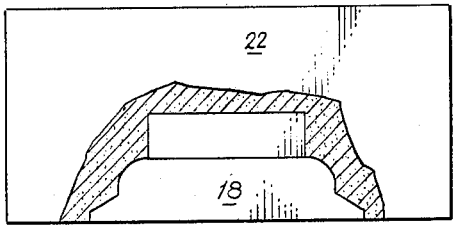
FIG. 5 is a side elevation of the upper portion of a mold (cope) partially broken away to show green sand rammed around the upper portion of a pattern.

The undercut space 32 may be prepared by any of various conventional procedures such as hard removal of sand in the drag lying adjacent to the ears 14 of casting 10. However, the arrangement illustrated in FIG. 4 shows pattern strips 17 that are placed under each ear 14 before ramming with sand and then slipped longitudinally out of suitable openings in the drag before the upper casting is made.

Figure 6:
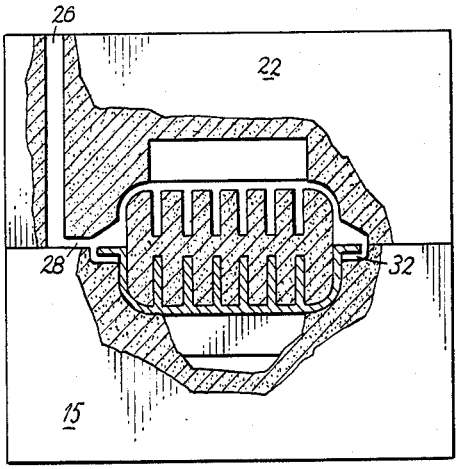
FIG. 6 shows a complete flask that contains the lower portion of a cast envelope containing a sand core in place in a sand mold as assembled for casting the top portion of the envelope integrally with the lower portion thereof.

A sand mold so formed provides elongate slits on opposite sides of the envelope adapted to confront the lateral ears 14 as shown by FIG. 6. As is apparent, a void or undercut space 32 beneath ears 14 is also formed whereby molten metal poured through the slits may flow into contact with the bottom side of ears 14. Upon cooling, the molten metal solidifies and fuses to both the upper and lower face of each ear, forming a strong, leakage-free bond therebetween.

I claim:

1. The method of making an envelope for a recuperative type heat exchanger comprising the steps of casting a bottom half of an envelope to form a concave wall that has a peripheral surface extending along a pair of opposite sides of said envelope, preparing a convex mold for a top half of said envelope that includes elongate slits on opposite sides thereof adapted to confront the internal surfaces on the top and bottom halves of the envelope, pouring a quantity of molten metal into the mold to form the top half of the envelope that includes a portion that confronts the slits and is contiguous with the peripheral surface on the bottom half of the envelope, and cooling the casting to fuse the molten metal of the top half of the envelope to the peripheral surface of the bottom half of the envelope thereby forming a fluid-tight bond therebetween.

2. The method of making an envelope for a recuperative heat exchanger as defined in claim 1 including the steps of providing a metallic flange extending outward from the peripheral surface on the bottom half of the envelope, and pouring a quantity of molten metal into the mold for the top half of the envelope to surround the flange thereby increasing the strength of the fusion joint between the lower half and the top half of the envelope.

3. The method of making an envelope for a recuperative heat exchanger as defined in claim 2 wherein the metallic flange on the bottom half of the envelope extends laterally to form a flange having a surface that is co-extensive with the peripheral surface thereof.

4. The method of making an envelope for a recuperative heat exchanger as defined in claim 3 wherein the lateral flange has a surface area several times that of the area of the peripheral surface.

5. The method of making an envelope for a recuperative heat exchanger as defined in claim 4 including the step of forming extended surface portions on an outer wall of said envelope that are cast integral therewith.

6. The method of making an envelope for a recuperative heat exchanger as defined in claim 5 wherein the mold includes a core of green sand that has impressed configurations normal to the extended surface on the outer wall of the envelope whereby pouring molten metal over said core produces extended surfaces on the inside wall of said envelope lying perpendicular to the extended surface on the outer wall.

* * * * *